US006418733B1

(12) United States Patent
Morent

(10) Patent No.: US 6,418,733 B1
(45) Date of Patent: Jul. 16, 2002

(54) METHOD AND DEVICE FOR PRESERVING SNOW

(76) Inventor: Ralf Morent, Jochstrasse 40, Hindelang D-67541 (DE)

( * ) Notice: Subject to any disclaimer, the term of this patent is extended or adjusted under 35 U.S.C. 154(b) by 0 days.

(21) Appl. No.: 09/674,499

(22) PCT Filed: May 11, 1999

(86) PCT No.: PCT/EP99/03213

§ 371 (c)(1),
(2), (4) Date: Jan. 24, 2001

(87) PCT Pub. No.: WO99/58910

PCT Pub. Date: Nov. 18, 1999

(30) Foreign Application Priority Data

May 11, 1998 (DE) ..... 198 21 027
Sep. 24, 1998 (DE) ..... 198 43 901

(51) Int. Cl.[7] ..... F25C 1/00
(52) U.S. Cl. ..... 62/66; 62/235; 62/260
(58) Field of Search ..... 62/66, 235, 260; 165/45; 239/14.2

(56) References Cited

U.S. PATENT DOCUMENTS 515,979 A * 3/1894 De Stoppani
3,751,935 A * 8/1973 MacCracken et al. ..... 62/235
3,815,377 A * 6/1974 Tyree, Jr. ..... 62/62
3,893,507 A 7/1975 MacCracken et al. ..... 165/46
3,919,858 A 11/1975 Garland et al. ..... 62/498
4,790,531 A * 12/1988 Matsui et al. ..... 239/2.2
5,400,966 A * 3/1995 Weaver et al. ..... 239/14.2
5,970,734 A * 10/1999 Stillwell et al. ..... 62/235

FOREIGN PATENT DOCUMENTS

| | | |
|---|---|---|
| DE | 297 16 437 | 1/1998 |
| EP | 0 436 523 | 7/1991 |
| EP | 0 684 659 | 11/1995 |
| GB | 292623 | 11/1928 |
| GB | 2 223 567 | 4/1990 |
| JP | 142052 | 6/1980 |
| WO | 91/00488 | 1/1991 |
| WO | 92/22026 | 12/1992 |

* cited by examiner

*Primary Examiner*—William E. Tapolcai
*Assistant Examiner*—Mohammad M. Ali
(74) *Attorney, Agent, or Firm*—Jacobson Holman, PLLC

(57) ABSTRACT

The invention relates to a method and device for preserving snow. A cooling mat device (2) is laid out on predetermined areas of a subbase (1) on which snow should be preserved. A coolant is fed to said cooling mat device via a coolant supply line (21), and the coolant is removed via a coolant return line (22).

28 Claims, 2 Drawing Sheets

METHOD AND DEVICE FOR PRESERVING SNOW

BACKGROUND OF THE INVENTION

1. Field of the Invention

The invention concerns a process and a device for making snow durable.

2. Description of the Related Art

Critical points on ski runs, such as e.g. overloaded and narrow downhill areas, south-slope areas, and areas with valley slopes, are generally covered with artificial snow, in order to be able to ensure a longer skiing season. One problem in this is an extremely high consumption of water. Generally, the water required for producing artificial snow is stored in water reservoirs and pumped to the individual snow guns with the aid of pumps. When artificial snow generated in this way melts, large quantities of water are formed, which flow down the mountainsides, drain away, and are thus lost. Another problem consists of the fact that when covered with artificial snow, the environment is damaged significantly. This is due especially to the fact that artificial snow flows more slowly into the ground and is therefore pushed to the side when traveled on, so that the ground is thus uncovered faster and is therefore damaged. When such partly released ground regions are uncovered, the danger also exits that skiers are injured seriously while skiing.

A process for making snow durable is known from printed document U.S. Pat. No. 3,893,507, in which a cooling-mat device is placed directly on a ski slope, not further defined, and then covered with sand or something similar. After that, a layer of artificial show or natural snow is applied to the cooling-mat device. This layer is cooled as needed. There is a problem in this in that the cooling-mat device can be damaged by the ground, especially by traffic, and in addition the vegetation on the ground can be permanently disturbed by the cooled cooling-mat device and the sand layer. Application of the sand layer at the start of the winter season and its removal after the winter season should be so problematical that cooling of ski slopes cannot be realized in the manner described.

SUMMARY OF THE INVENTION

This task is solved by a process for making snow durable on certain regions of natural ground, by an applied cooling-mat device through which a coolant is fed through a coolant-supply line and removed through a coolant-return line, the cooling-mat device being placed on a snow layer already existing on the natural ground that has previously been leveled with a roller or something similar, and another snow layer being applied to the cooling-mat device, and the snow layers being cooled by the cooling-mat device.

This task is solved by a process with the characteristics of patent claim 1 and a device with the characteristics of patent claim 20.

The essential advantage of the present invention is in the fact that by simply placing cooling mats in desired areas a ski run can be achieved that is cooled for artificial or natural snow to the extent that an undesired rapid melting of the natural or artificial snow can be avoided. Since natural or artificial snow can be prevented from rapid thawing in these critical points in a relatively simple way, a significantly longer ski season can be assured. Cross-country and downhill courses especially can be made durable in the manner according to the invention to withstand ski races and similar things, so that such competitions can be held relatively independently of weather conditions. In addition, it is also guaranteed that all skiers encounter the same conditions during such a competition, as far as possible.

However, the essential advantage of the present invention consists of the fact that the enormous water consumption associated with the traditional snow gun can be reduced by making the snow durable. Since the mats used in connection with the present invention have lines with a very small diameter, there is only a relatively small need for coolant.

An especially preferred embodiment of the invention involves using Glysantin or a similar environmentally friendly coolant, advantageously containing a colorant that indicates the place of a failure in case of a line break. It is then particularly easy to gain access to the failure site for repair, and the line can be clamped off from the system by simple heating and melting, in which case the function of the entire system is essentially maintained.

In an especially preferred embodiment, the mat device has input funnels, into which a drilling device can be introduced from the side away from the ground in an especially simple manner and pushed into the ground, so that tilting rods can be inserted later and attached to the ground.

Additional advantages and embodiments of the invention can be seen from the subclaims.

BRIEF DESCRIPTION OF THE DRAWINGS

In the following, the invention and its embodiments will be explained in more detail in connection with the diagrams.

Here.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
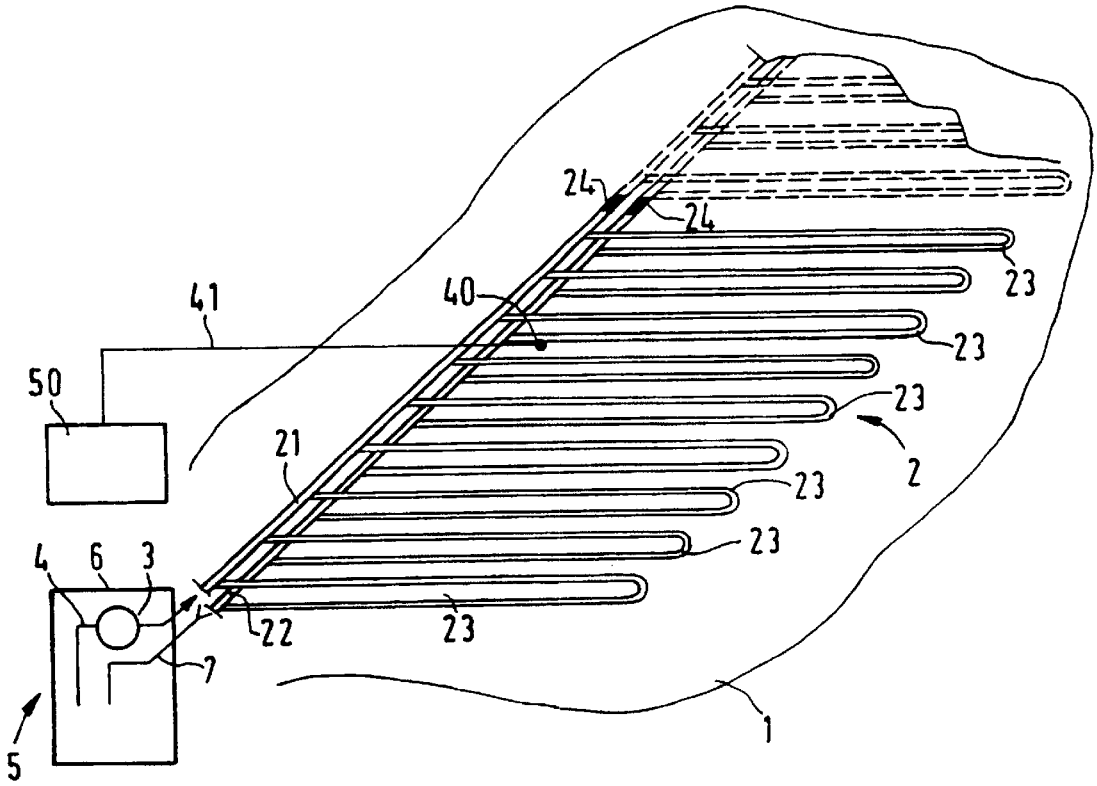
FIG. 1 shows a schematic representation to explain the process according to the invention for making snow durable.

According to FIG. 1, by to the process according to the invention a cooling mat device 2 is placed on ground 1 on which the snow is to be made durable. The ground 1 involves, for example, an especially critical point of an alpine downhill run that is under a high load, the area of a valley slope of a ski region, an alpine downhill or slalom course, or something similar. The cooling-mat device 2 includes a coolant-supply line 21, a coolant-return line 22, and line hoses running between them 23. The coolant-supply line 21 is fed by a pump 3, which takes the coolant through a line 4 from a coolant reservoir 5. From the supply line 21, the coolant arrives through the hoses 23 at the area to be cooled 1 and finally at the coolant-return line 22 and from there back to the coolant reservoir 5 (line 7). The coolant used involves an environmentally friendly coolant, preferably Glysantin. The coolant reservoir 5 and the pump 4 are advantageously attached to a case 6 or a support stand, movable or stationary, and the cooling-mat device 2, when not needed on the ground 1 can likewise be stored in the case 6.

In order to make the snow on the ground 1 durable, we proceed as follows: After the cooling-mat device 2 has been spread on the ground 1, coolant is pumped from the coolant reservoir 5 through the supply line 21 and the return line 22 through the line hoses 23. In this case, the ground 1 and its surface are cooled in the region of the cooling-mat device, for example to a temperature in the range from −3 to −7° C. Because of the humidity of the surrounding air, the cooling-mat device is thereby covered with ice. When artificial or natural snow is applied to the cooling-mat device 2 from above (arrow direction P), this snow is not melted, because of the cooling of the ground 1 and the cooling-mat device 2, so that no melt water arises, as is the case in the state of the art, and the ground 1 can be traveled on practically as long as the cooling-mat device 2 is operated. If necessary, worsened conditions caused by snow being scraped and pushed away can be compensated by spraying later artificial snow from snow guns.

In the embodiment of FIG. 1, in which the supply line 21 and the return line 22 run parallel, an especially uniform cooling of the ground is achieved, since the coolant of the cooled side is returned as coolant to the supply side.

Figure 3:
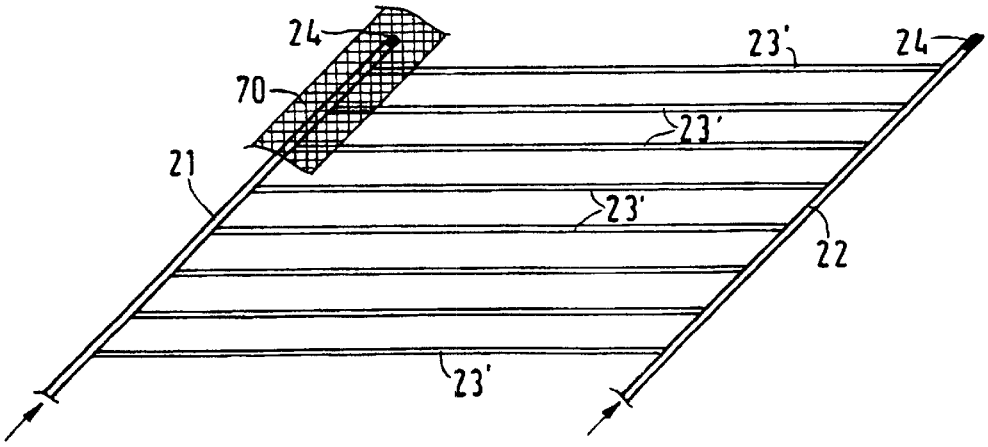
FIGS. 3 through 5 show further developments of the invention.

In the embodiment illustrated in FIG. 3, in which the supply line 21 and the return line 22 are at a distance from each other corresponding to the length of the lines 23' and run parallel to each other, a double width of the ground 1 can be covered with the cooling device 2, in which case, however, it must be taken into account that greater warming of the coolant occurs along the lines 23'.

Figure 2:
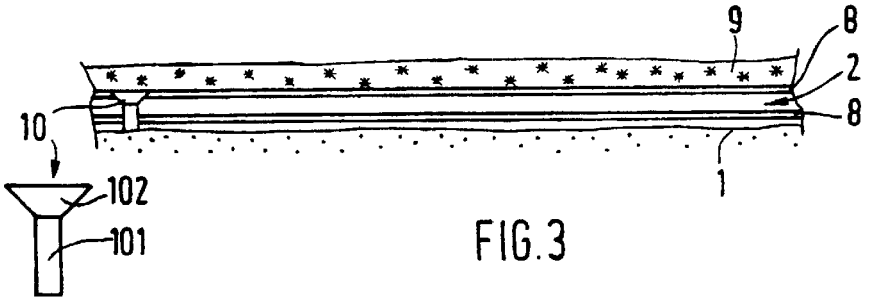
FIG. 2 shows a cross-section through the mat device used in connection with the invention.

FIG. 2 shows a cross-section through the present cooling-mat device 2. According to it, a cooling-mat device 2 is placed on the ground 1, which may already have a snow layer, consisting of individual hoses 23 connected to the supply line 21 and the supply line 22. When cooled by the cooling-mat device 2, a protective layer 8 of snow and ice arises advantageously on the ground 1, which protects the ground 1 from mechanical damage. Such a protective layer of snow and ice 8 also arise on the surface of the cooling-mat device 2. The artificial or natural snow 9 is then applied to this protective layer 8.

In the manner shown in FIG. 2, in order to avoid damage to it, funnel devices 10 can be arranged with the system itself on the ground, in order to avoid damage to it, which are inserted through holes between the line hoses 23 or 23'. These funnel devices 10 have the form of tubes 101 that have funnel-shaped expansions 102 on the side away from the ground 1. Since the places of the funnel devices are known, drills can also be inserted into the mat devices 2 from the side away from the ground when it is covered by snow through the expansions 102 and then inserted into the ground 1 automatically through the tube 101, so that holes can be drilled for attaching tilting rods or similar things without damaging the mat device 2.

When the lines of the line hoses 23 of the system of FIG. 1 have a length of six meters, a width of ground 1 of six meters can be covered with the system. When the supply line 21 and the return line 22 are separated from each other in the manner shown in FIG. 3, a width of ground 1 of twelve meters can be covered.

The mat device 2 can be constructed with any desired length, because stopper parts 24 are used at the free ends to close the supply line 21 and the return line 23. For an extension, these stopper parts 24 are removed, so that additional mat-device parts can be connected to lines 21 and 22, which, if they are not to be extended in turn and therefore represent only intermediate parts, are then closed by the stopper parts 24.

In connection with FIGS. 4 and 5, which show a longitudinal section and a top view of the mat device 2, another embodiment is described, in which nap-like projections 30, 30' are arranged on the mat device 2, which are connected from above or below to lines 23 or 23'. The nap-like projections 30, 30' which project downward or upward from the lines 23, 23', are preferably open at the bottom or top, so that snow and/or ice can be captured in them. This brings the advantage that the snow has an even better hold on the mat device. For this reason, the lines 23, 23' are better protected from outside effects, such as those cause e.g. by ski edges or run rollers.

Advantageously, the nap-like projections 30, 30' are attached in the form of strips, in which the projections 30, 30' are each connected on the side (in the transverse direction) by means of elements 31 that can be plugged into the lines 23, 23' at particular distances on the mat devices 2. The strips run in the longitudinal direction of the mat device 2 (FIG. 5). The elements 31 have advantageously the form of cap parts adapted to the shape of the cross-shaped cross-section of the lines, which are likewise made with a cross shape and can be plugged into the lines 23, 23'. In this way, the strips with the projections 30, 30' can be inserted into the lines 23, 23' in the direction transverse to the mat device and can be removed from them at any time. Advantageously, several mat devices can be connected together in the longitudinal direction with strips of this type.

The downward projections 30 are used as spacers from the ground and therefore protect the mat device 2 from stones other objects.

The projections 30, 30' can also serve to attach the mat device 2 to the ground, in which case holding elements, advantageously in the form of needles 32 or prongs can be driven into the ground through the upward and downward projections 30, 30' or only through the downward projections 30.

The strips with the projections 30 or 30' consist advantageously of plastic, which can be reinforced with metal inserts.

The downward projections 30 and the upward projections 39' can be attached to each other by means of plug connections 33.

When the lines 23 are made into loops, the strips are appropriately each attached to only one line 23 of a loop, in which case the other line of the loop is placed advantageously between two adjacent upward projections 30'.

With the present mat devices, a number of objects can be formed from snow or ice, because of their flexibility. In particular, so-called "half pipes" or similar land formations can be made for snowboarding and jumps can be constructed for trick skiing or ski flying. In this ways, the best conditions can be created for these kinds of sports, even in less favorable regions in a relatively small space. It is likewise possible to made sculptures and all kinds of objects of snow or ice durable for longer periods of time; this can also be possible in enclosed spaces or in regions with warm or hot climates (e.g. ski jumps in pedestrian zones of cities, "half pipes" on the beach, igloos in the desert, etc.).

In the following, especially preferred processes for making snow durable with the present cooling-mat devices 2 will be explained.

When a cooling-mat device 2, consisting of several cooling-mat parts, is placed on ground 1 that is already covered with a snow layer, a run roller or another clearing device first pushes snow layer with a depth of, for example, 30 cm from away from an existing surface of the ground 1, so that a smoothed surface arises, onto which the cooling-mat parts of the cooling-mat device 2 are placed and connected through flexible plastic hoses to the coolant reservoir 5.

Artificial snow can then be sprayed by snow guns onto the cooling-mat device 2 that has been placed in the regions or snow can be applied from the edge of the cooling-mat device 2 with the aid of the run roller. In the latter case, care must be taken that the cooling-mat device 2 is not cooled before the run roller is used, since the individual cooling-mat parts could break when the run roller is used.

With the installation method described above, a relatively large snow surface can be made durable on the ground 1 advantageously within a short time. This procedure is especially recommended in the spring (February through April), when individual regions of the run thaw due to strong solar radiation and heating to the ground 1, or snow can be made temporarily durable on park areas or similar places while large events are being held.

A procedure in which a snow layer is applied with the cooling-mat parts on ground 1 already covered with a snow layer in connection with to a cooling-mat device 2 is especially advantageous. If warm coolant, heated for example to about 20 to 60° C. in the coolant reservoir 5, is then fed through the cooling-mat device 2, the individual cooling-mat parts are warmed, so that they sink into the snow layer already present on the ground 1. Advantageously, the individual warm cooling-mat parts are elastic when stepped on or when a run roller is used, so that they do not break. When the external temperature is very cold, this can be achieved through a better connection between the snow and the cooling-mat device 2 by melting.

At the end of the winter season, the cooling-mat devices can be warmed up in the manner described above, for example to 40° C., so that they melt out of the snow, become elastic thereby, and are cleaned at the same time. In this case, it is advantageous that no ice layers are formed when the snow melts. From the point of view of environmental protection, this corresponds to a natural thawing.

It is especially advantageous if the connections from one individual cooling-mat parts to another and the connections to the coolant reservoir 5 are made of flexible plastic hoses. A complicated and cost-intensive welding of the cooling-mat parts to each other is therefore not required. Instead, the individual cooling-mat parts are connected to each by a plug process. If the flexible plastic hoses are transparent, there results the advantage that are accumulations become visible from the outside, so that a faultless cooling operation can be assured.

The artificial plastic-hoses can be rolled up appropriately, and they can therefore be rolled out on site from these hose rolls. This brings a significant space savings in transportation and storage. Likewise, flexible plastic hoses can be used to repair damaged line in the cooling-mat parts.

Advantageously, in order to increase the flexibility of the process, the hose connections between the coolant reservoir 5 and the supply and return lines 21, 22 are made with so-called check-valve connections, as are known for example from garden-watering system. By this means, it can be assured that the connection to the coolant reservoir 5 can be made or broken within seconds, without the coolant coming out of the supply line 21 or the return line 22.

In connection with the process according to the invention, it is especially important that cooling of the cooling-mat device 2 must be made only temporarily. For example, the connection between the cooling-mat device 2 and the cooling reservoir 5 can be turned off after the cooling-mat device 2 has been cooled initially, advantageously for about 24 hours, with a coolant at about −11 to −20° C. Even with fairly strong solar radiation, as appears especially in the months of March and April, no great changes are to be expected over four to five days. The hard-snow layer of about 20 to 40 cm formed during the cooling is adversely affected only by very strong solar radiation and especially be an increase in ground temperature in the spring. During the cold season, in the months of November through February, almost no adverse effects are to be expected. It is therefore sufficient that a highly efficient cooling-mat device 2 forms a hard-snow layer at the start of the cooling period, for about 24 hours, in the region of the cooling-mat device 2. This cooling device can then be disassembled and connected to another cooling-mat device for another field to be cooled. Measuring sensors 40 are installed advantageously to the cooling-mat devices 2, which report the status of each cooling-mat device 2 to a central computer 50 through a line 41 (FIG. 1). As soon as a particular value, advantageously the ratio of the snow temperature to the snow depth is exceeded in the region of the cooling-mat device, a smaller suitable device of about 9 kw can deliver coolant from the coolant reservoir 5 to the cooling-mat device 2. In this way, cooling devices can be saved.

The individual lines 23, 23' of the cooling-mat parts can be fused together advantageously in the case of damage with the aid of a specially prepared brazing piston from a power supply and be made fully functional, regardless of whether it is lying in snow. It has been observed that with PE lines, this kind of fused connection can withstand a pressure of about 35 bars. Since the operating pressure is about 2 bars, this is more than sufficient.

Figure 4:
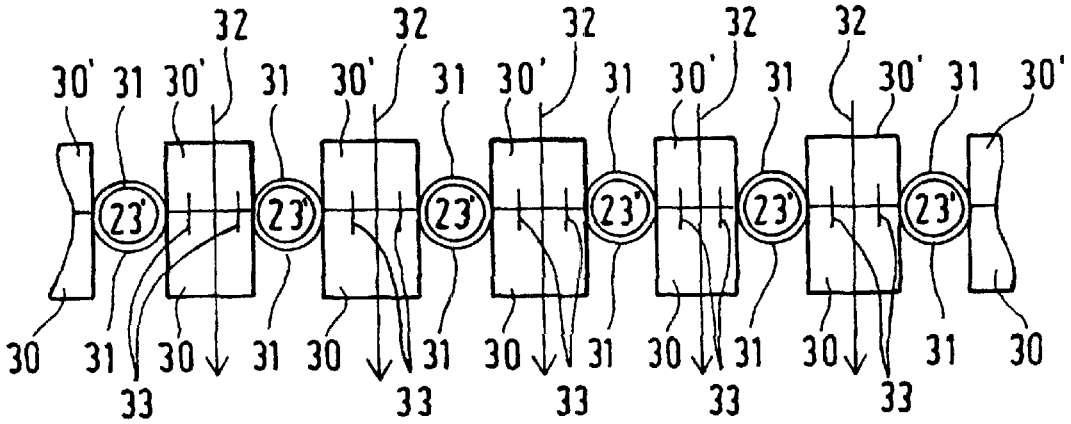
Figure 5:
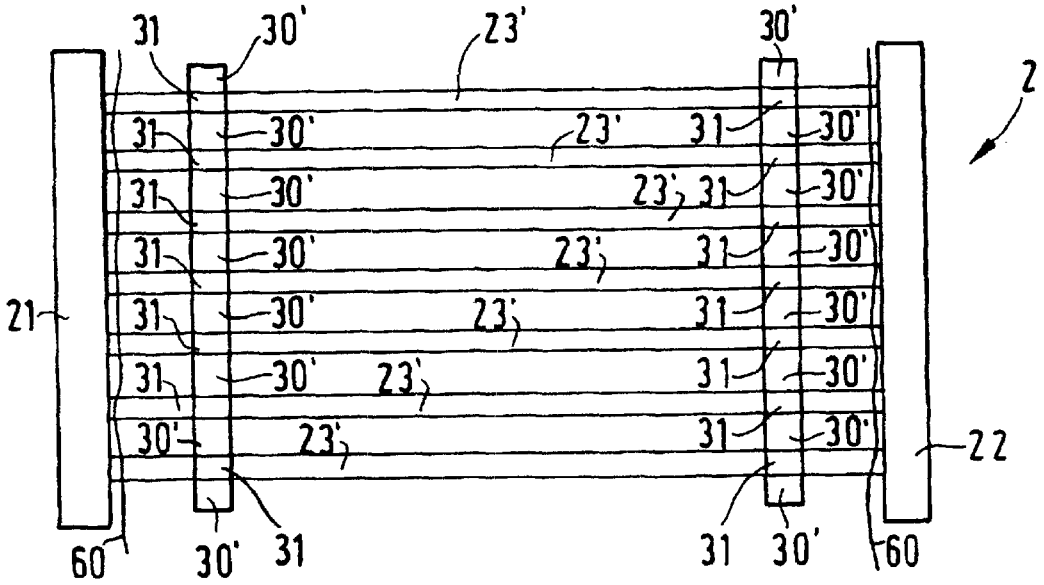

Instead of the nap-like projections 30, 30' described in FIGS. 4 and S, which also serve as spacers, it is conceivable to use simple structural adhesive strips consisting of the same material as the mat-device parts. These adhesive strips make it possible for the mat-device parts to be rolled in and out with the thin lines 23, 23' getting tangled* or knotted. Transportation of the mats is thereby facilitated. [* German "verhedern" should be "verheddern"]

When the present cooling-mat device 2 is applied to ground 1 already covered with a snow layer or directly with spacers onto snow-free ground 1, so that the ground is at a distances of about 10 to 25 cm, a snow layer is formed as a snow buffer by the cooling-mat device 2 between the ground 1 and the cooling mat device, which prevents the ground from being insulated by air, so that vegetation is not affected adversely. The resulting hard-snow layer is comparable to natural ice sheets on runs.

In order to indicate to operators of run rollers and similar things the presence of already installed cooling-mat devices 2 that are not visible, it is recommended that especially the edges of the cooling-mat device 2 be provided with thin metal strips 60, the presence of which is detected and signaled by sensors in the run rollers. In this way, damage by inappropriate traffic on the cooling-device mat 2 can be avoided.

To protect the edges of the cooling-mat device 2, especially in very steep areas (slope greater than 28%), it is recommended that lattice strips 70 known in the trade (e.g. under the trademark Gittex®) be placed about 10 cm above the edges of the cooling-mat device 2. This lattice structure, which connects the hard-snow layer into a very compact and stable protective layer above the edges of the cooling-mat device 2, is recognized immediately by personnel of a run roller, especially when it is colored e.g. blue, so that further traffic on and damage to the edges of the cooling mat can be avoided.

An especially promising use of the present cooling-mat devices 2 is recommended in regions where the release of avalanches are to be feared. The present cooling-mat devices are placed in such dangerous regions and held, for example with the aid of metal rods driven into the ground between lines 23, 23' of the mat-device parts. By temporary cooling of this dangerous region, adherence of the snow mass on it to the ground is achieved, so that the release of especially dangerous ground avalanches can be avoided.

There are additional fields of use of the present cooling-mat devices are in the region of the approach tower of ski jumps or as so-called "greens" in winter golf courses. The cooling-mat devices can guarantee constant competitive conditions for all participants by cooling or warming, since the ground temperature can be kept constant by means of them. For example, it can be avoided that the approach trail of a ski-flying jump is strongly frozen in the morning and very soft in the afternoon. For example, bridges over brooks in ski runs can be provided with a snow layer that has been made durable by installation of the present cooling-mat devices. It is also conceivable to create and operate for a long time cross-country courses in areas with relatively little snow by installing the present cooling-mat devices.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A process for making snow durable on natural ground, by an applied cooling-mat device through which a colored coolant is fed through a coolant-supply line and removed through a coolant-return line, which comprises placing the cooling-mat device on a snow layer already existing on the natural ground that has previously been leveled, applying another snow layer to the cooling-mat device, and cooling said cooling-mat device and said snow layers with said colored coolant and indicating any leak in said cooling-mat device by said colored coolant coloring adjacent snow.

2. The process according to claim 1, wherein the coolant is taken from a coolant reservoir by a pump and fed to the coolant-supply line, said coolant being returned through the coolant-return line to the coolant reservoir.

3. The process according to claim 1, wherein the coolant is Glysantin.

4. The process according to claim 1, wherein a surface of the ground in a region of said cooling-mat device is cooled to a temperature of about −3° C. to about −7° C. by the cooling-mat device.

5. The process according to claim 1, wherein snow is applied to the cooling-mat device on a side of said device which faces away from the ground.

6. The process according to claim 1, wherein the cooling-mat device is produced by connecting the coolant-supply lines and the coolant-return lines of several cooling-mat parts.

7. The process according to claim 2, wherein the coolant is warmed such that said cooling-mat device melts and thereby sinks into the existing snow layer.

8. The process according to claim 7, wherein the coolant is warmed in the coolant reservoir.

9. The process according to claim 8, wherein the coolant is warmed to about 20 to 60° C.

10. The process according to claim 7, wherein the coolant is warmed by feeding warm water through the cooling-mat device.

11. The process according to claim 1, and further comprising detaching the cooling-mat device from the natural ground by thawing, feeding warm water through the cooling-mat device such that said device is melted out from the snow on the ground.

12. The process according to claim 1, and further comprising connecting a plurality of cooling mat parts of the cooling-mat device with flexible plastic hoses.

13. The process according to claim 1, wherein the cooling-mat device is cooled only temporarily, after an initial cooling, when a predetermined value is exceeded, involving durability status of the snow cooled by the cooling-mat device.

14. The process according to claim 13, wherein the predetermined value is formed from a ratio of snow temperature to snow depth in a region of the cooling-mat device.

15. Use of the process according to claim 1 to make snow durable in points of alpine courses that are under a high load, including at least one of valley slopes of a ski area, alpine downhill courses, slalom courses, cross-country ski courses, half-pipes, bridges in a skiing region, parking lots, and avalanche-release regions.

16. A process for making snow durable on natural ground, by an applied cooling-mat device through which a coolant is fed through a coolant-supply line and removed through a coolant-return line, comprising placing the cooling-mat device on a snow layer already existing on the natural ground that has previously been leveled, applying another snow layer to the cooling-mat device, and cooling said cooling-mat device and said snow layers, funnel devices being placed when the cooling-mat device is arranged on the ground, said funnel devices having a form of tubes that have funnel-shaped expansions on sides thereof which face away from the ground, said expansions enabling a drill to be inserted through the expansion in the tube from the side facing away from the ground, in order to drill holes for attaching tilting rods.

17. A cooling-mat device for making snow durable on natural ground, comprising a coolant reservoir, a coolant-supply line receiving coolant from said coolant reservoir, a coolant-return line returning coolant to said reservoir, and a plurality of coolant lines separated from each other in a longitudinal direction of said cooling-mat device, said plurality of coolant lines running from the coolant-supply line to the coolant-return line, ends of said coolant-supply line and said coolant-return line not leading to the coolant reservoir being closed by closing devices, said cooling-mat device being placed on a snow layer already existing on the natural ground that has previously been leveled, another snow layer being then applied to the cooling-mat device, and said cooling-mat device being cooled and thereby cooling said snow layers.

18. The cooling-mat device according to claim 17, wherein the supply line and the return line are connected to the coolant reservoir through check-valve connections, which prevent coolant from flowing out.

19. The cooling-mat device according to claim 17, wherein a lattice structure is placed in the snow above edge regions of the cooling-mat device for mechanical protection thereof.

20. The cooling-mat device according to claim 17, wherein the coolant-supply line is arranged at one end of said plurality of coolant lines and the coolant-return line is arranged at a distance from said coolant-supply line at the other end of said plurality of coolant lines, the distance corresponding with a length of said plurality of coolant lines.

21. The cooling-mat device according to claim 17, wherein the coolant-supply line and the coolant-return line are arranged adjacent to each other and the plurality of lines connecting them are line hoses.

22. The cooling-mat device according to claim 17, wherein flexible structural strips are provided running in the longitudinal direction and are individually connected to the plurality of coolant lines at distances from each other.

23. The cooling-mat device according to claim 17, wherein the device includes elements that can be detected by a sensor device arranged in a vehicle.

24. The cooling-mat device according to claim 23, wherein the elements are metal strips arranged at least in edge regions of the cooling device.

25. Use of the cooling-mat device according to claim 17 to make snow durable in points of alpine courses that are under a high load, including at least one of valley slopes of a ski area, alpine downhill courses, slalom courses, cross-country ski courses, half-pipes, bridges in a skiing region, parking lots, and avalanche-release regions.

26. The cooling-mat device according to claim 17, further comprising a plurality of cooling mat parts connected to each other with flexible plastic hoses to form said cooling-mat device.

27. The cooling-mat device according to claim 26, wherein said plastic hoses are transparent.

28. The cooling-mat device according to claim 17, and further comprising funnel devices having a form of tubes with funnel-shaped expansions on sides thereof which face away from the ground, said funnel devices for attaching tilting rods.

* * * * *